United States Patent [19]

Corbman et al.

[11] 4,314,888

[45] Feb. 9, 1982

[54] ZONE CONTROL OF LEAN GAS UNDERFIRING FOR COKE OVENS

[75] Inventors: Philip Corbman, Monsey, N.Y.; Paul V. Faber, Morristown, N.J.

[73] Assignee: Wilputte Corporation, New Providence, N.J.

[21] Appl. No.: 176,072

[22] Filed: Aug. 7, 1980

[51] Int. Cl.[3] ..... C10B 5/02; C10B 5/18; C10B 21/02; C10B 21/18

[52] U.S. Cl. ..... 202/143; 202/151

[58] Field of Search ..... 202/139, 140, 141, 142, 143, 144, 151

[56] References Cited

U.S. PATENT DOCUMENTS

| | | | |
|---|---|---|---|
| 1,522,421 | 1/1925 | Crossen | 202/143 X |
| 1,596,408 | 8/1926 | Ditto . | |
| 1,968,367 | 7/1934 | Becker . | |
| 2,098,013 | 11/1937 | Pavitt | 202/142 |
| 2,155,954 | 4/1939 | Pavitt | 202/141 |
| 2,488,175 | 11/1949 | Davis . | |
| 2,872,385 | 2/1959 | Hartewig et al. | 202/141 |
| 3,056,732 | 10/1962 | Forliti . | |
| 3,192,129 | 6/1965 | Becker . | |
| 3,494,834 | 2/1970 | Ackeren . | |
| 3,567,588 | 3/1971 | Steding et al. | 202/139 X |
| 4,039,391 | 8/1977 | Gensler . | |
| 4,085,008 | 4/1978 | Kinzler . | |

FOREIGN PATENT DOCUMENTS

| | | | |
|---|---|---|---|
| 489125 | 8/1931 | Fed. Rep. of Germany | 202/144 |

*Primary Examiner*—Bradley Garris

*Attorney, Agent, or Firm*—Buell, Blenko, Ziesenheim & Beck

[57] ABSTRACT

A coke oven battery of the type that is underfired with coke oven gas, wherein a system of horizontal bus flues and valve controls therefor is provided for controlling the supply of lean gas fuel, such as blast furnace gas or any other lean gas, selectively to the gas flues in heating zones of the coke oven chamber walls and the recirculation of waste gas therefrom, so as to achieve the optimum fuel consumption under varying bulk density conditions of the coal mass in the coke oven chamber from the coke side to the pusher side.

5 Claims, 13 Drawing Figures

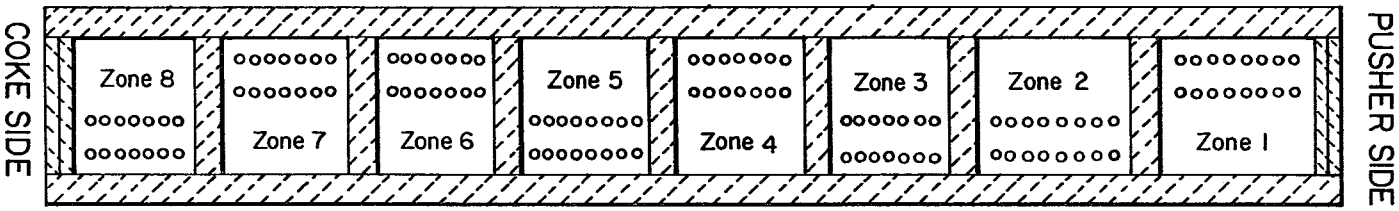
Fig. 3. View Through Regenerator
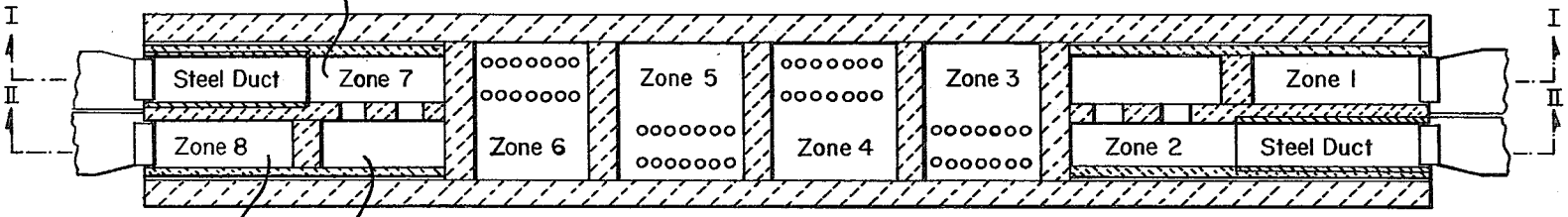
Fig. 4. View Through Upper Bus Flue
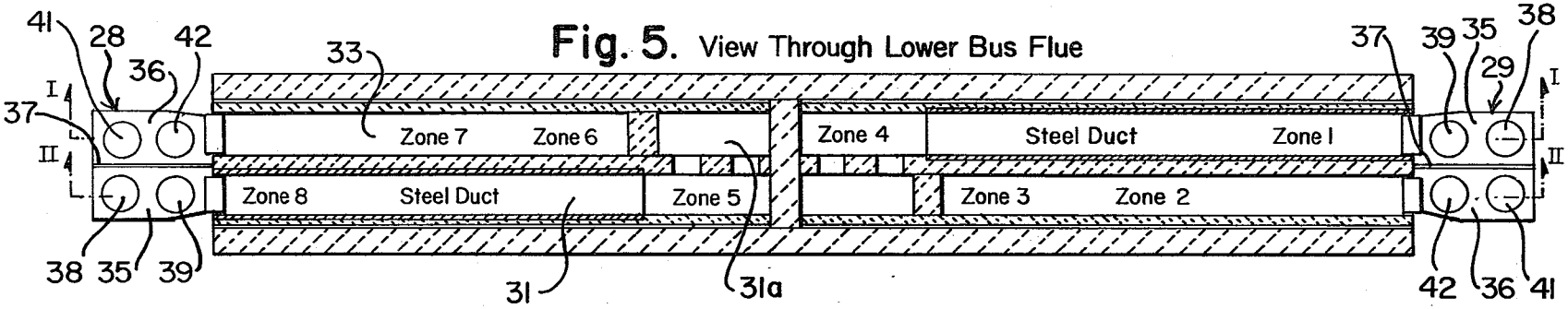
Fig. 5. View Through Lower Bus Flue A - Air or B.F. Gas WG - Waste Gas

ZONE CONTROL OF LEAN GAS UNDERFIRING FOR COKE OVENS

This invention relates to a method and means for controlling the distribution of blast furnace gas or any other lean gas to the heat flues in the coke oven chamber walls of underfired coke ovens in order to achieve optimum fuel consumption under conditions of varying bulk density of the coal mass in a coke oven chamber from the coke side to the pusher side.

The terms blast furnace gas or lean gas as used in this disclosure refer to any coke oven underfiring gas that would require preheating in the regenerator chamber before being burned in the vertical heating flues.

Field experience with charging of coke ovens with preheated coal, particularly oven top charging, indicates that the bulk density of the coal from the coke side to the pusher side varies, with the greater bulk density occurring under the points of coal entry into the coke oven chambers. We have concluded that in order to achieve optimum consumption of lean gas fuel, such as blast furnace gas, for heating the coke oven walls, it would be desirable if the amount of heat imparted to the coal mass in the coke oven chamber could be varied from the coke side to the pusher side in conformity with the bulk density of the coal mass in the coke oven chamber. In coke ovens underfired with coke oven gas such control can be achieved by changing the coke oven gas metering pins to each individual flue or by changing the gas nozzles in the heating flues of a gas gun battery. However, when using blast furnace gas or any other lean gas for underfiring or for combination underfiring, it is usually not possible to vary the fuel to each individual zone because of the method of introducing the lean gas through the regenerators up into the vertical flues.

In accordance with our invention, we provide a coke oven battery having eight heating zones, four of which are burning at one time, with waste gas, air and blast furnace gas reversing valves on both the coke and pusher sides of the battery. The regenerator chambers and the bus flues are separated by a division wall at the center of the battery. The heating flues are arranged to approximate two 4-divided oven batteries back-to-back. The bus flues from each side of the battery are divided into four ducts.

On the pusher side one of the upper ducts has openings into zone 1, and the other upper duct has openings into zone 2 while one of the lower ducts has openings into zone 3, and the other lower duct has openings into zone 4. On the coke side one of the upper ducts has openings into zone 8, and the other upper duct has openings into zone 7, while one of the lower ducts has openings into zone 6, and the other lower duct has openings into zone 5.

In a typical heating sequence, when firing from both the coke side and the pusher side, the outer zones 1 and 8 and 4 and 5 are burning while the inner zones 2 and 3, and 6 and 7 are waste gas exhaust zones. Upon reversal, the burning zones 1, 4, 5, 8 become exhaust zones and the exhaust zones 2, 3, 6, 7 become burning zones.

On each side of the battery, the waste gas, air and blast furnace gas reversing valve units fit into the oven brick work and each has four compartments. The compartments on one vertical side of the valve unit are connected so that when the valve in that compartment unseats it feeds either air or blast furnace gas into the bus flues of alternate regenerators. The compartments on the other vertical side of the valve unit are connected so that when the valve in that compartment unseats, waste gas from the bus flues is exhausted. An individual damper is provided for each of the four compartments or ducts to control the flow of the gases into each of the bus flue and also the flow of waste gas from the bus flue.

The above arrangement of bus flues is such as to permit adjustment of the heat input to the wall opposite any one of the eight zones independently of the heat input to any of the other zones.

We are aware of prior designs of coke ovens in which there is a control of the distribution of heat to the coke oven chamber. For example, in the Didier oven, the vertical flues are arranged in groups and the control of the gases to the individual groups of flues is by means of finger bars in the air reversing valve.

In the Otto twin flue oven, the attempt to control the air or the lean gas is by means of the air control plates which is a long and tedious method of balancing the oven. On a change of flues for underfiring, the air control plates must be removed and the openings readjusted. This is not a satisfactory method.

In the Carl-Still ovens with the lean gas being fed into the vertical flues at multiple fixed elevations, the control of the fuel gas to the individual flues cannot be changed once the brickwork has been erected.

A preferred embodiment of our invention is more fully described hereinafter in connection with the accompanying drawings, wherein:

FIG. 3 is a horizontal sectional view through the coke oven battery of FIGS. 1 and 2, showing the relative locations of the heating flues or zones represented therein, as well as that of the openings in the top of the bus flues taken generally on line III—III of FIG. 1;

FIG. 4 is a horizontal sectional view through the coke oven battery of FIGS. 1 and 2, taken generally on the line IV—IV of FIG. 1, showing the relative locations of the heating flues or zones represented therein, as well as the openings in the top of the bus flues;

FIG. 5 is a horizontal sectional view through the coke oven battery of FIGS. 1 and 2, taken generally on the line V—V of FIG. 1, showing the relative locations of the heating flues or zones represented therein, as well as the disposition of the reversing valves in connection with the bus flues;

Figure 1:
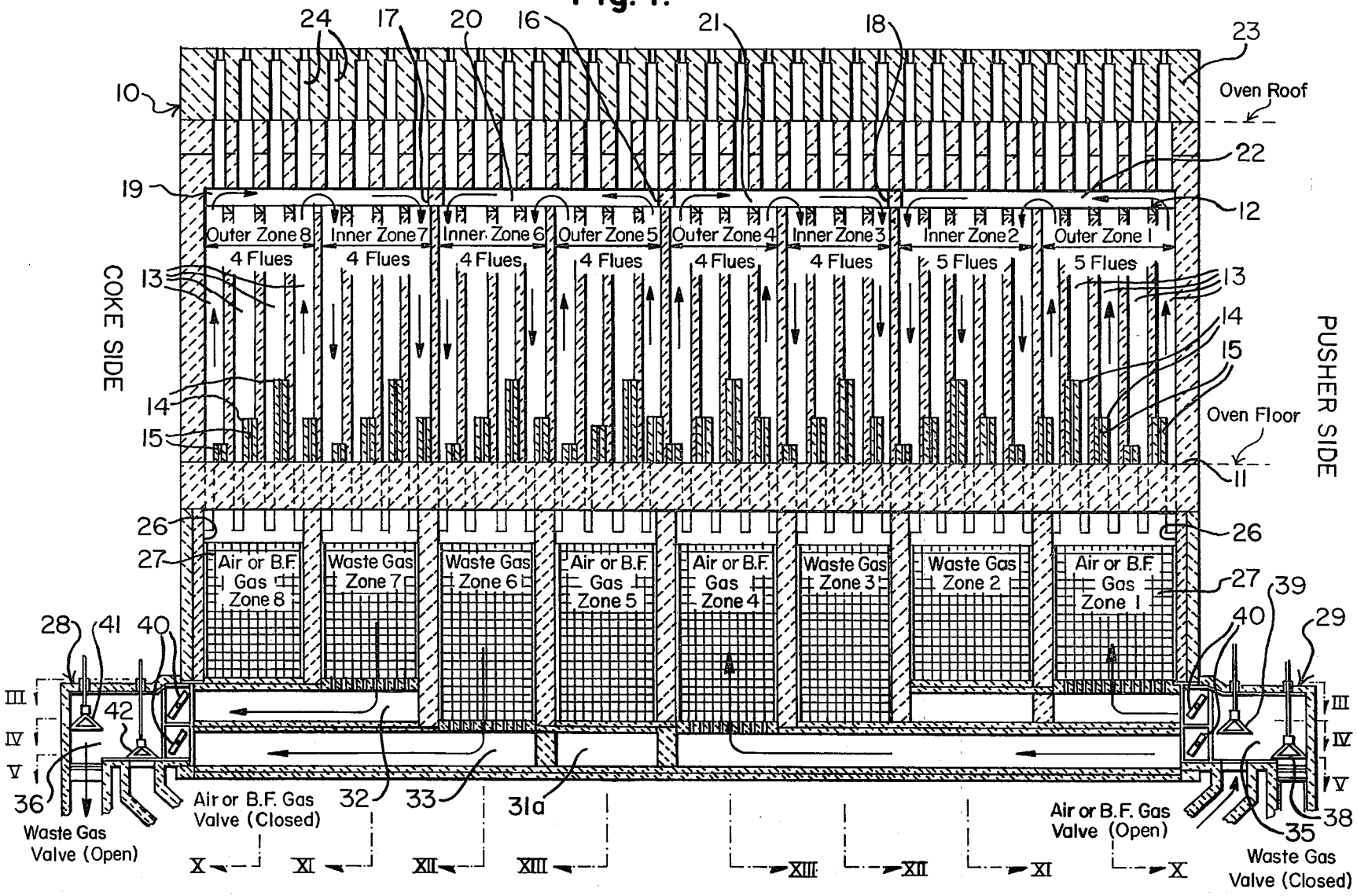
FIG. 1 is a longitudinal sectional view through a coke oven battery embodying our invention, from the coke side to the pusher side.
Figure 2:
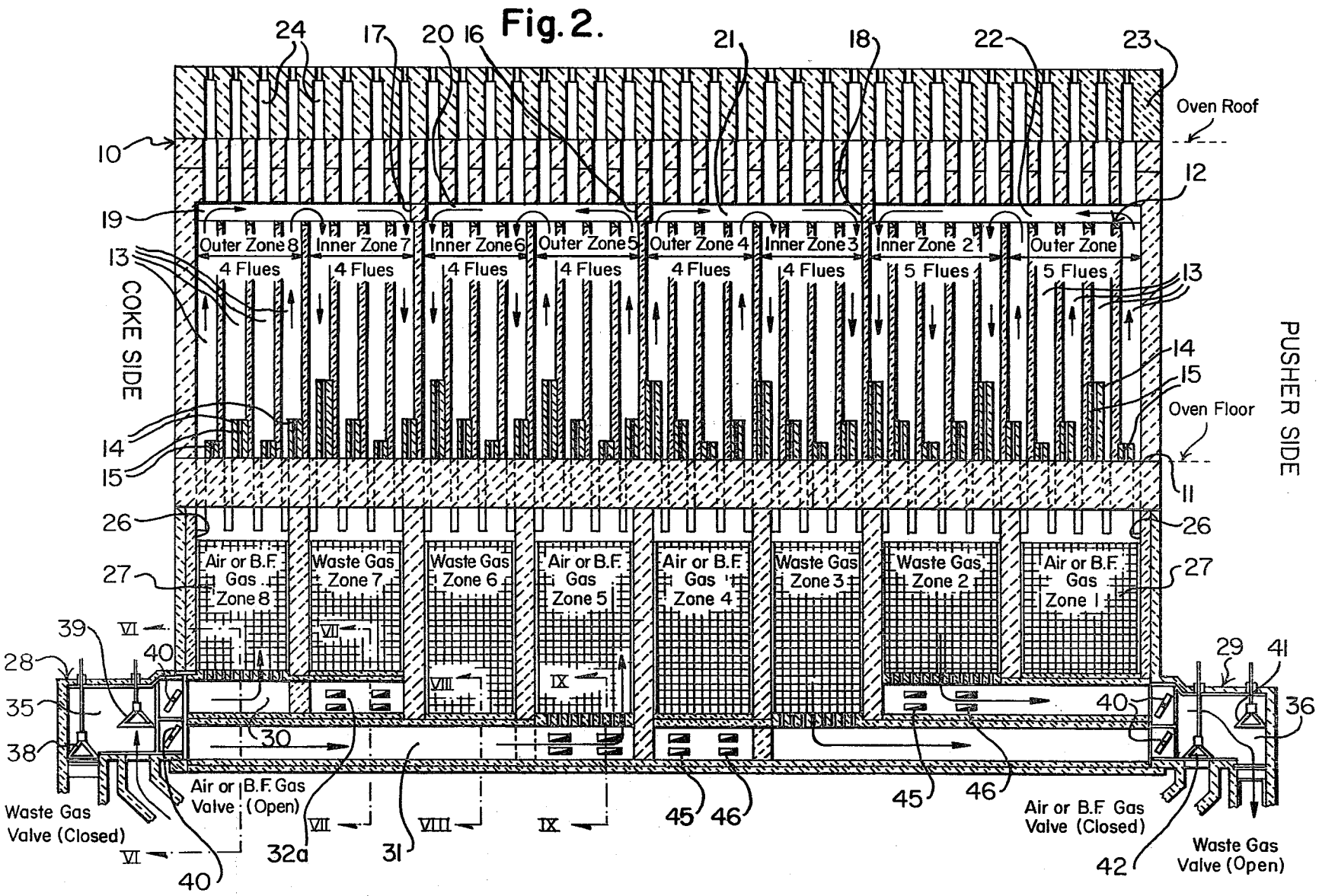
FIG. 2 is a longitudinal sectional view through the same coke oven battery of FIG. 1 but which is on a different plane from that of FIG. 1.
Figure 6:
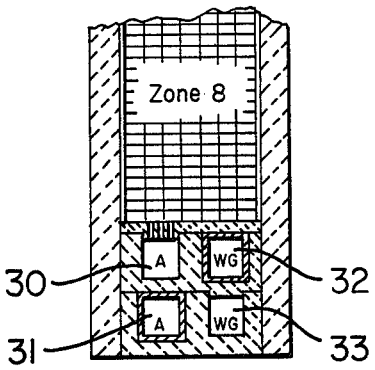
FIG. 6 is a fragmental sectional view, taken generally in zone 8 on the line VI—VI of FIG. 2, showing the relative locations of the bus flues for air or blast furnace gas with respect to that for waste gas.
Figure 7:
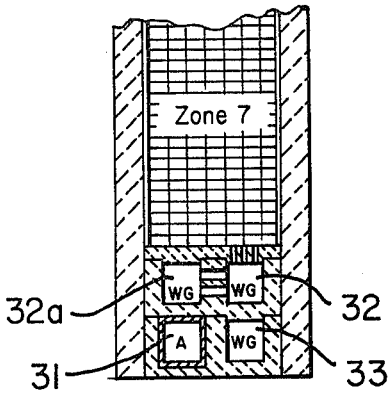
FIG. 7 is a fragmental sectional view, taken generally in zone 7 on the line VII—VII of FIG. 2, showing the relative locations of the bus flues for waste gas with respect to that for air or blast furnace gas.
Figure 8:
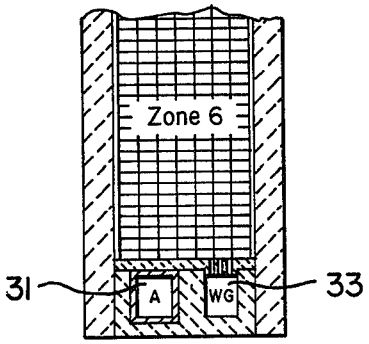
FIG. 8 is a fragmental sectional view; taken generally in zone 6 on the line VIII—VIII of FIG. 2, showing the relative locations of the bus flues for waste gas with respect to that for air or blast furnace gas.
Figure 9:
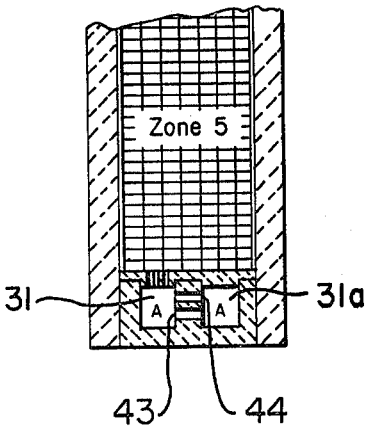
Figure 10:
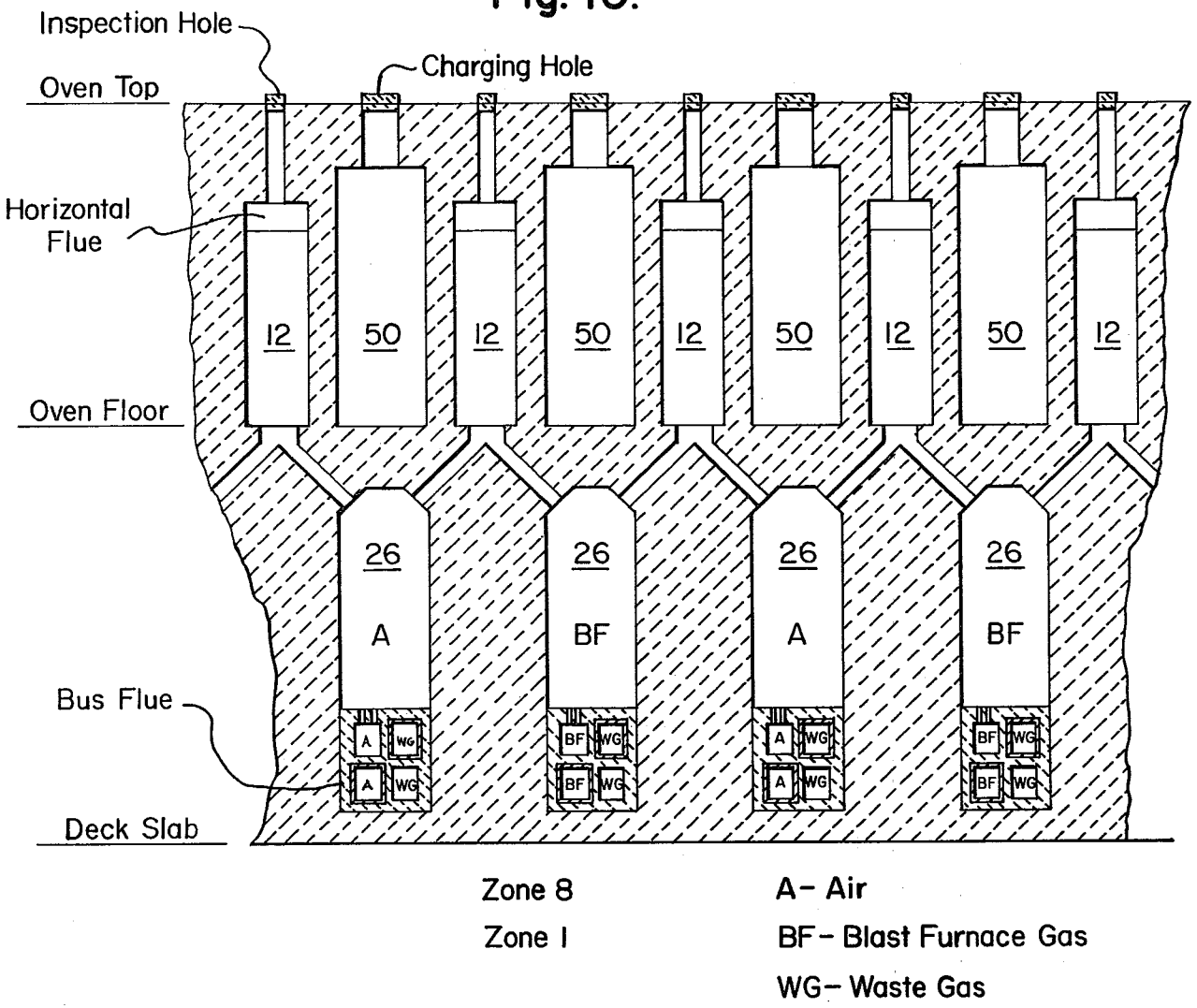
Figure 11:
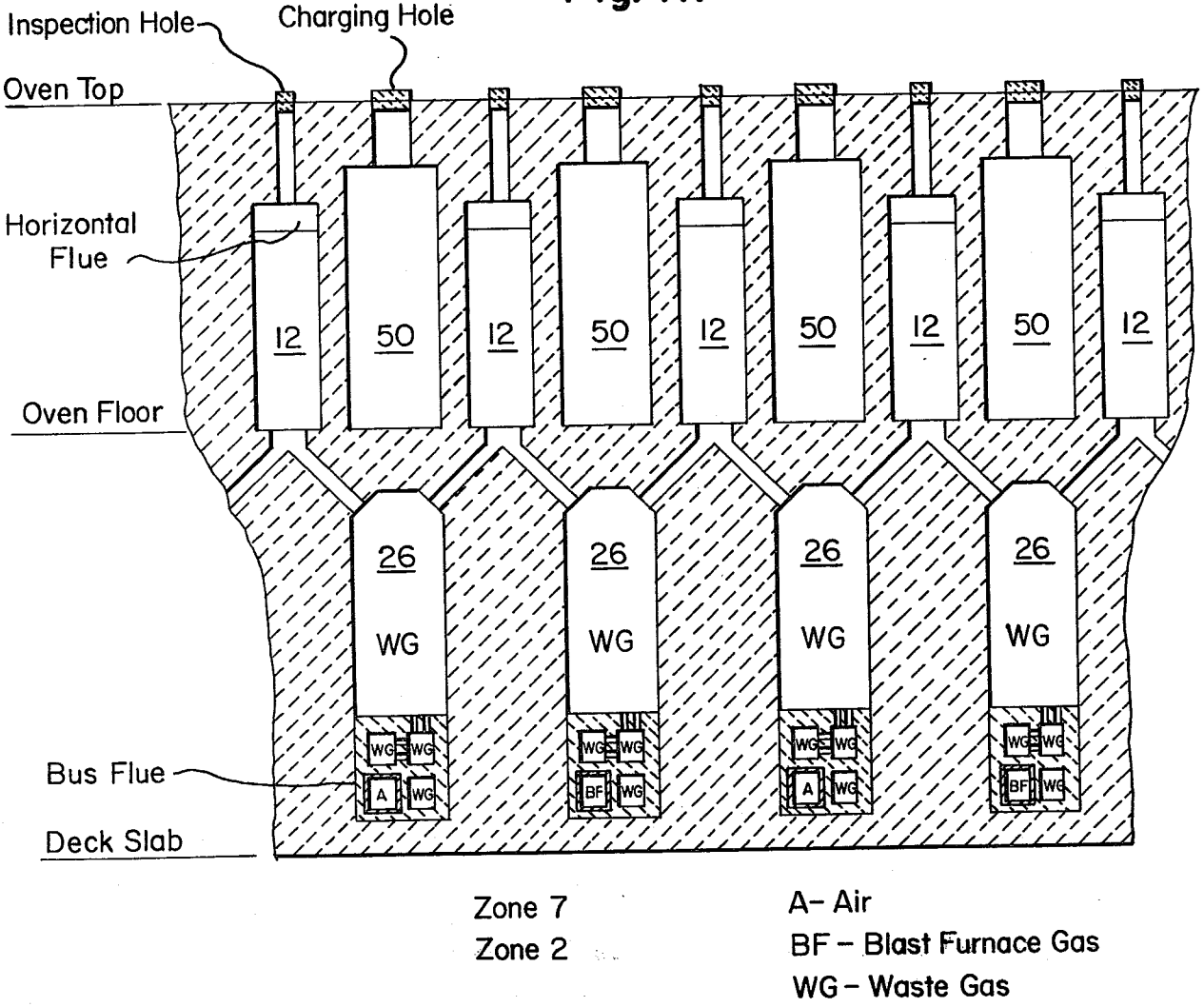
Figure 12:
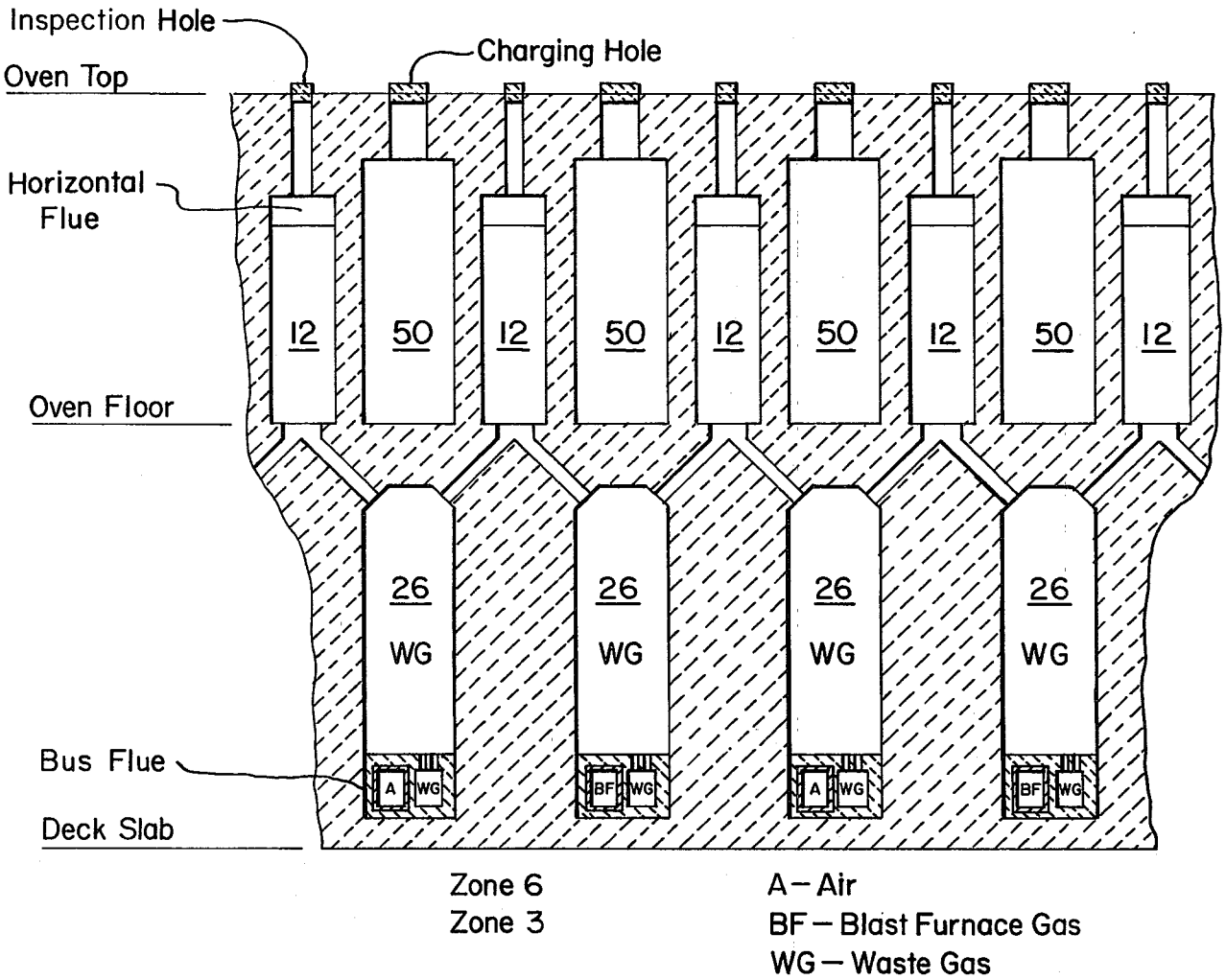
Figure 13:
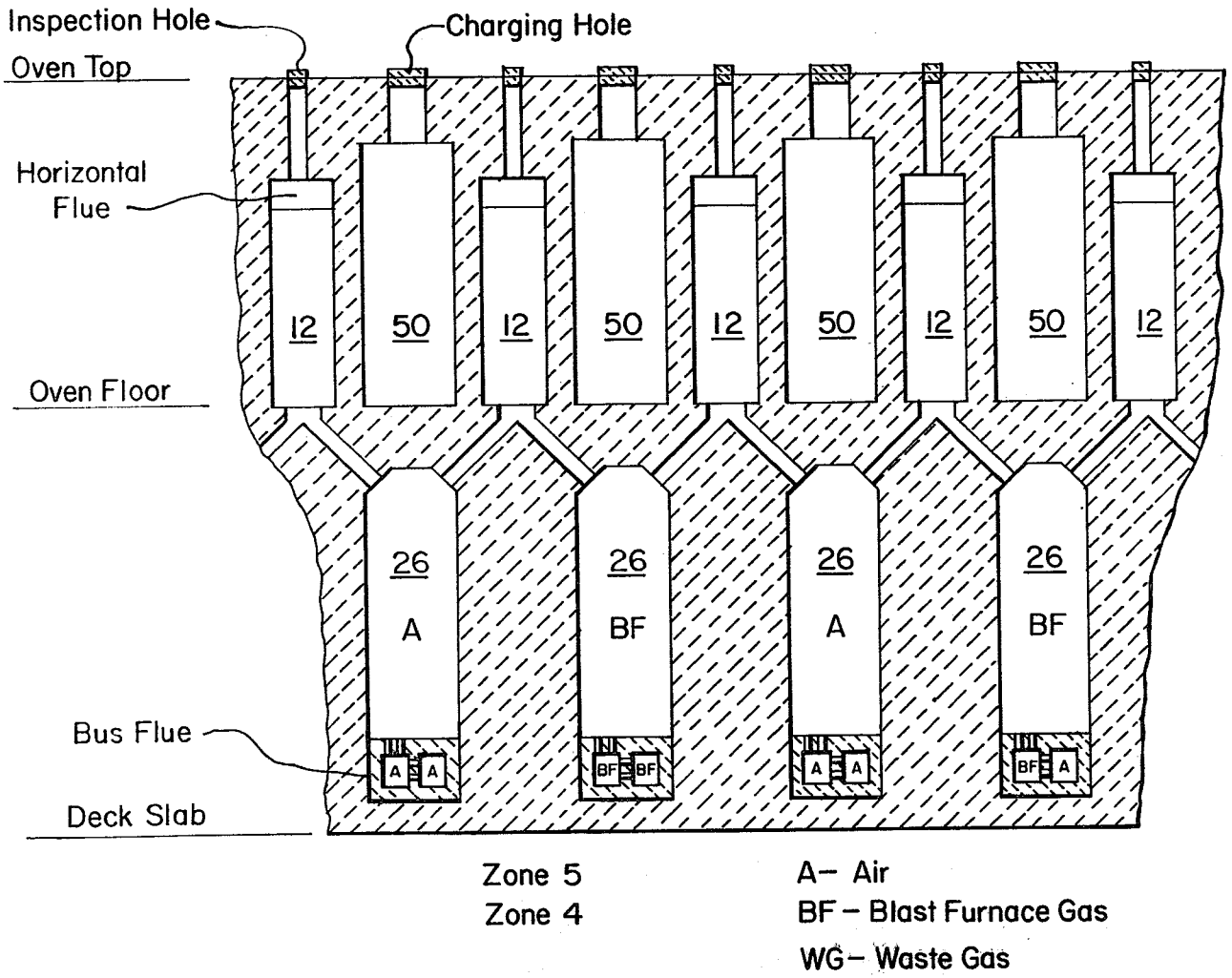

FIG. 9 is a fragmental sectional view, taken generally in zone 5 on the line IX—IX of FIG. 2, showing the relative locations of the bus flues for air or blast furnace gas with respect to waste gas; and FIGS. 10, 11, 12 and 13 are fragmentary transverse views through a battery of coke ovens, taken generally on the lines X, XI, XII, and XIII indicated in FIG. 1, showing the relation of the regenerator rooms 26 to the coke oven chambers 50 and the respective heater walls 12 for the oven chambers and indicating the flow of air, blast furnace gas, or waste gas in the bus flues for control of different combinations of zones, namely 8-1, 7-2, 6-3 and 5-4.

Referring to the drawings, especially FIGS. 1 and 2, the coke oven 10 comprises a conventional coke oven structure having an oven floor 11 and walls 12, one of which is shown. The walls 12 are of refractory material, such as brick, and are constructed with a multiplicity of vertically extending flues 13 in parallel spaced relation, with burners 14 of varying height built therein. The burners have passages 15 through which coke oven gas is introduced into the flues. Substantially midway between the opposite ends of the horizontal flue of the coke oven 10, designated respectively the coke side and the pusher side according to conventional practice, is a partition wall 16 of refractory material such as brick, which divides the coke oven 10 generally into two parts in back-to-back relation. The horizontal flue of the coke oven 10 to the left of the horizontal flue partition 16 is further divided longitudinally by a vertical partition or wall 17, while that part of coke oven 10 to the right of the partition wall 16 is further divided longitudinally by a vertical partition or wall 18. At the top of the wall 12 are constructed a number of horizontal flue passages 19, 20, 21 and 22 through which communication is established between groups of vertical flues 13 hereinafter referred to as zones. For convenient reference, the zones on the right-hand side of wall 16 are identified respectively as outer zone 1, inner zone 2, inner zone 3, and outer zone 4. Shown is a typical vertical flue arrangement in which zones 1 and 2 each include five flues 13 and in which zones 3 and 4 each include four flues 13. The number of vertical flues in each zone may vary.

The zones on the left-hand side of partition wall 16 are hereinafter referred to as outer zone 5, inner zone 6, inner zone 7 and outer zone 8, each zone including four flues 13.

The top of the coke oven 10 is constructed in conventional manner to provide a roof 23 having flue inspection openings 24 through which to observe heating in the vertical flues.

Also provided on the top of each vertical heating wall 12 are movable slide bricks (not shown) which can be adjusted over the top of each vertical flue for proper combustion.

For the sake of this description, the coke oven chambers in which coal is converted to coke are not shown except in FIGS. 10–13, since this disclosure is concerned with the oven heating system.

Beneath the oven floor 11 (FIGS. 1 and 2) there is shown conventionally a number of regenerator rooms 26 having brickwork 27 therein for preheating gases, such as air or blast furnace gas, before the air or blast furnace gas supplied via the reversing valve units 28 and 29 are fed into the vertical flues 13.

During blast furnace gas underfiring combustion air and waste gas flow through separate compartments of the regenerator under one oven while blast furnace gas and waste gas flow through separate compartments of the adjacent regenerator. The air from one regenerator mixes with the blast furnace gas from the adjacent regenerator at the base of the vertical flue and burns in the vertical flue.

As will be apparent from the diagram of FIG. 3, the bus flues of zone 1 and those of zone 4 are aligned longitudinally as are the bus flues of zone 6 and those of zone 7. Similarly, the bus flues of the zones 2 and 3 are aligned longitudinally as are the bus flues of the zones 5 and 8.

Referring to FIGS. 1 and 2, as well as to FIGS. 3, 4–9, it will be seen that four horizontally extending bus flues or ducts 30, 31, 32 and 33 beneath the regenerator rooms 26 are provided through which fuel gas, such as blast furnace gas, or air is supplied through the regenerator to the vertical flues of two zones, for example, zones 5 and 8, and through which waste gas is circulated back through the vertical flues and regenerators of two zones, such as zones 6 and 7. The arrangement of horizontal ducts or bus flues for zones 1 and 4 is similar to that already described for zones 5 and 8. Similarly, the arrangement of horizontal ducts or bus flues for zones 2 and 3 is similar to that for zones 6 and 7. Accordingly, it is deemed unnecessary to repeat the cross sectional views therefor corresponding to FIGS. 6–9.

As will be understood from the diagrammatic view of FIGS. 1, 2 and 5, the valve units 28 and 29 are inserted into the brickwork so as to provide two chambers 35 and 36 side-by-side and separated by a partition or dividing wall 37. In chamber 35 are a pair of valves 38 and 39 operable on vertical stems alternatively into and out of seated position. In chamber 36 a pair of valves 41 and 42 similarly operate alternatively into and out of seated position.

As will be seen in FIG. 2, the bus flues 30 and 31 are both connected into chamber 35 via pivoted dampers 40. It will also be seen from FIG. 2 that the bus flues 30 and 31 communicate respectively with the flues of zone 8 and of zone 5 via the brickwork of the regenerator rooms 26. Thus, with the valve 39 unseated, as shown in FIG. 2, it will be apparent that air or a fuel gas such as blast furnace gas will be supplied simultaneously to the flues of zone 8 and zone 5. Also, as seen in FIG. 1, waste gas simultaneously flows back via the cross-passages 19 and 20 from zone 8 to zone 7 and from zone 5 to zone 6. With the valve 41 in chamber 36 of valve unit 28 (FIG. 1) unseated, the waste gas is discharged respectively through the bus flues 32 and 33 from zones 7 and 6 to the discharge port of the valve unit 28.

In a smilar manner, valve unit 29, as shown in FIG. 1, controls the supply of air or a fuel gas such as blast furnace gas, simultaneously to the flues of zones 1 and 4 and through valves 39 to the regenerator rooms 26 beneath those zones, while waste gas flowing from the flues of zones 2 and 3 (FIG. 2) is discharged via the bus flues, dampers 40, and past valve 41 of valve unit 29.

A plurality of passages 43 and 44 (FIG. 9) are provided in the dividing wall between bus flues 31 and **31*a* beneath zone 5 and also in the dividing wall between bus flues 32*a* and 32 (FIG. 7) beneath zone 7 to provide for constant purging for the portion of the bus flue which is not connected to the regenerator. Similarly, a plurality of passages 45 and 46 (FIG. 2) are provided in zone 4 and in zone 2**, for the constant purging of the portion of the bus flue that is not connected to the regenerator.

It will be seen that we have described above a battery of coke ovens, each coke oven having eight heating zones, four of which are burning at one time. With the simplified reversing valve arrangement disclosed, different combinations of heating zones may be attained to evenly distribute the application of heat throughout the length of the heating wall and thus control the heat over the individual portions of the length of the heating wall of the coke oven chamber. Moreover, by reason of dampers 40 in each of the bus flues, individual control of flow of gases through each zone may be had.

The necessary apparatus for operating the valves of the valve units 28 and 29 as well as the dampers 40 is omitted from the drawings but it will be understood that conventional apparatus is provided for this purpose.

The dampers 40 in the air, blast furnace and waste gas reversing valves may be connected into the operation of the reversing mechanism so that when the valves are being used for air or blast furnace gas the dampers will have one setting and at reversal the reversing mechanism will operate the dampers 40 so as to be set in an optimum position for controlling the flow of waste gas from the regenerators.

By reason of the control exercised over the flow of lean gas through the regenerator rooms 26 to the paired zones of flues, we achieve optimum fuel consumption notwithstanding varying bulk density conditions of the coal mass in the coke oven chamber.

While we have disclosed a specific embodiment of apparatus for control of a multiplicity of zones of heating flues in coke oven chamber walls, it will be apparent that variations and modifications may be made therein within the terms of the appended claims.

What we claim is:

1. A coke oven battery having coke oven chambers with heating walls therefor and adapted when charged with wet or preheated coal to assume a varying bulk density of the charging coal from the coke side to the pusher side of the oven, wherein the improvement comprises an arrangement of vertical flues in each of said heating walls in an even number of spaced zones, sequentially positioned and extending from the coke side to the pusher side of the oven, each zone being defined by refractory partitions between which are a plurality of heating flues, refractory means defining passages between the top end of the flues in one zone and the top end of the flues in an adjoining zone, so as to form a pair of zones, a pair of horizontal ducts positioned side-by-side and extending below both zones of a pair, partition means in one of said ducts dividing it into separate spaces corresponding to the zones thereabove, a passage from one separate space in that duct into the corresponding zone of that pair and a passage from another separate space in that duct below the other zone of that pair into the adjoining horizontal duct.

2. The battery of claim 1 including four zones, the first pair adjoining an end of the oven chamber and the second pair adjoining the first pair, in which the said horizontal ducts extend below the first pair of zones only and including a second pair of horizontal ducts extending below the first pair of horizontal ducts and below the second pair of zones, partition means in one duct of said second pair dividing it into separate spaces corresponding to zones of the second pair thereabove, a passage from one separate space in that duct into the corresponding zone of the second pair, and a passage from another separate space in that duct below the other zone of that pair into the adjoining horizontal duct of said second pair.

3. The battery of claim 1 including separate reversible control valves for each duct at said end of the oven chamber for simultaneously controlling flow of fuel gas or air and waste gas in said ducts and individually controlled damper means positioned between each of said ducts and said reversible control valves.

4. A coke oven battery having coke oven chambers with heating walls therefor and adapted to be charged with wet or preheated coal which assumes varying bulk density from the coke side to the pusher side of the oven, each said oven chamber having a floor and regenerator means located below said oven floor, wherein the improvement comprises an arrangement of flues in said heating walls in an even number of separated zones sequentially positioned and extending from the coke side to the pusher side of the oven, each zone comprising a group of heating flues, passage means at the top of each said heating wall providing communication between groups of flues in two adjoining zones, and a plurality of ducts below said regenerator means arranged in an upper pair of ducts side-by-side and a lower pair of ducts side-by-side, one of which supplies fuel gas or air through one duct of a side-by-side pair to the bottom of the flues in one zone through one of the regenerator means and another of which conducts waste gas through the other duct of a side-by-side pair from the bottom of the flues in another zone that is connected via said passage means to said first zone through another of the regenerator means, partition means in some of said ducts dividing off a separate space therein corresponding to the regenerator means above it, a passage from that separate space into the adjoining duct, and reversible valve means for controlling the flow of fuel gas or air and waste gas through said ducts.

5. A coke oven battery having coke oven chambers which when charged with wet or preheated coal develops a varying bulk density from the coke side to the pusher side of the coking oven chamber, each said coke oven chamber having at least one heating wall containing a multiplicity of vertically extending heating flues and burners therein, wherein the improvement comprises partitions in said wall separating the flues into eight zones, separate passages connecting the first and second zones, the third and fourth zones, the fifth and sixth zones and the seventh and eight zones respectively, numbered from the pusher side, at their upper ends, two pairs of horizontal ducts positioned below the flues, the first and second ducts lying side-by-side and the third and fourth ducts lying side-by-side beneath the first and second ducts, respectively, the first and second ducts extending from the pusher side beneath the first and second zones only and from the coke side beneath the seventh and eighth zones only, a partition in the first duct beneath the first and second zones, a passage from that duct into the first zone, a partition in the second duct between the seventh and eighth zone, a passage from that duct into the eighth zone, the third and fourth ducts extending from the pusher side below the third and fourth zones only and from the coke side below the fifth and sixth zones only, a partition in the third duct between the fourth and fifth zones and a partition between the fifth and sixth zones, a passageway connecting that duct with the sixth zone, a partition in the fourth duct between the fourth and fifth zones, a partition between the fifth and sixth zones and a passage between that duct and the fifth zone, a passage from the first duct space beneath the second zone into the adjoining second duct, a passage from the second duct space below the seventh zone into the adjoining first duct, a passage between the fourth duct space below the fourth zone into the adjoining third duct and a passage between the third duct space beneath the fifth zone into the adjoining fourth duct.

* * * * *